US011103903B2

(12) United States Patent
Himebaugh et al.

(10) Patent No.: US 11,103,903 B2
(45) Date of Patent: Aug. 31, 2021

(54) BALL CIRCULATION PUMP SKID AND RELATED METHOD

(71) Applicant: OVIVO INC., Montreal (CA)

(72) Inventors: Jacob C. Himebaugh, South Jordan, UT (US); Trevor R. Auman, Sandy, UT (US)

(73) Assignee: OVIVO INC., Montreal (CA)

( * ) Notice: Subject to any disclaimer, the term of this patent is extended or adjusted under 35 U.S.C. 154(b) by 141 days.

(21) Appl. No.: 16/209,138

(22) Filed: Dec. 4, 2018

(65) Prior Publication Data

US 2020/0171555 A1 Jun. 4, 2020

(51) Int. Cl.

| | |
|---|---|
| ***B08B 9/057*** | (2006.01) |
| ***B08B 9/032*** | (2006.01) |
| ***B08B 3/10*** | (2006.01) |

(52) U.S. Cl.

CPC ..... *B08B 9/057* (2013.01); *B08B 3/10* (2013.01); *B08B 9/032* (2013.01); *B08B 2209/053* (2013.01)

(58) Field of Classification Search

CPC ..... B08B 2209/053; B08B 3/10; B08B 9/032; B08B 9/057; B08B 9/0551; B08B 9/0552; F28G 1/12

See application file for complete search history.

(56) References Cited

U.S. PATENT DOCUMENTS

| | | | | |
|---|---|---|---|---|
| 3,215,195 A * | 11/1965 | Friedrich | ..... | F28G 1/12 165/95 |
| 7,975,758 B2 * | 7/2011 | Ho | ..... | F28G 1/12 165/95 |
| 2004/0099406 A1 * | 5/2004 | Schildmann | ..... | B08B 9/055 165/95 |

* cited by examiner

*Primary Examiner* — Douglas Lee

(74) *Attorney, Agent, or Firm* — R. Neil Sudol; Henry D. Coleman

(57) ABSTRACT

In a hydraulic circuit including a ball circulation pump skid, a single pump, and a set of valves in a manifold of the ball circulation pump skid, the pump and valves are operated to move all fluid in the hydraulic circuit alternately along two paths through an operative device and a ball collection capsule in the manifold, so that none of the balls ever enter the pump. The first path enables (a) ball-containing fluid flow from the operative device to the ball collection capsule and (b) ball-free fluid flow from the ball collection capsule to the exactly one pump and back to the manifold. The second path provides for (c) ball-free fluid flow from the pump to the ball collection capsule and (d) ball-entraining flow from the ball collection capsule to the operative device.

11 Claims, 8 Drawing Sheets

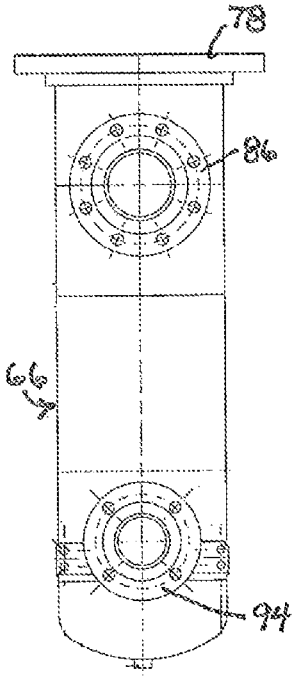
FIG. 6
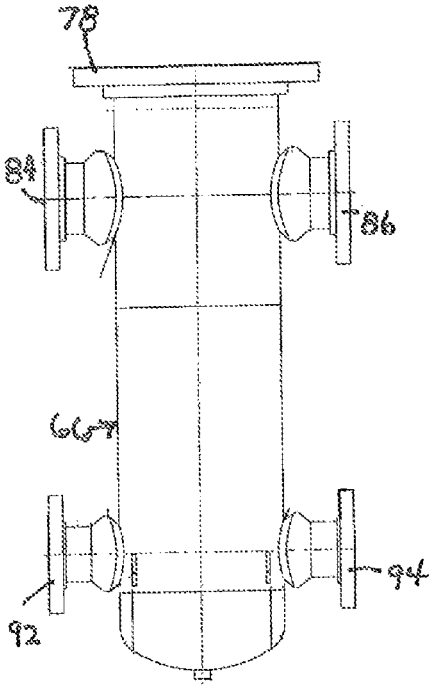
FIG. 5
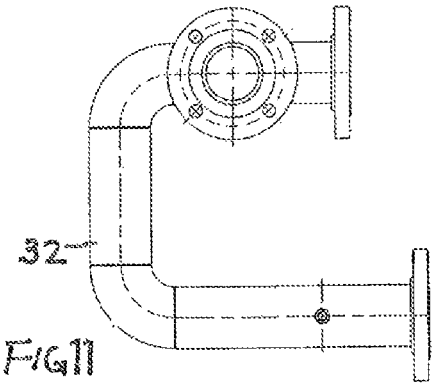
FIG 11
FIG. 12
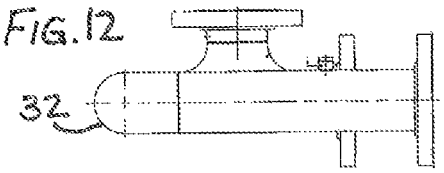

BALL CIRCULATION PUMP SKID AND RELATED METHOD

BACKGROUND OF THE INVENTION

This invention relates to a ball circulation pump skid. Such a pump skid includes rubber cleaning balls that travel with fluid circulating through a hydraulic circuit for cleaning the internal surfaces of the piping and the devices incorporated into the circuit.

Current ATCS (auto tube cleaning system) ball circulation pump skids require the cleaning balls to travel through the circulation pump during both the circulation and collection cycles. To prevent damage to the cleaning balls during operation, some systems include a centrifugal pump with a recessed impeller that minimizes the interaction between the pump impeller and the cleaning balls. This design has worked well and has proven to be a reliable solution to transfer the cleaning balls from an ATCS ball strainer discharge port or ports downstream of a condenser or heat exchanger to an injection point upstream of the equipment serviced.

Because recessed impellers are inherently less efficient than other impeller configurations, larger motors are required and a higher power consumption is experienced. The problem arises of modifying the system in some way to reduce costs associated with utilizing a centrifugal pump with a recessed impeller.

SUMMARY OF THE INVENTION

A ball circulation pump skid comprises, in accordance with the present invention, a base frame, a pump mounted to the base frame, and a piping manifold also mounted to the base frame. The piping manifold has a first inlet and a first outlet each connected to the pump. The manifold is further provided with a second inlet and a second outlet connectable to an external device, such as a condenser or heat exchanger. The manifold houses a ball collection capsule configured to permit flow of fluid and entrained cleaning balls into the ball collection capsule in a first flow direction and to permit flow of fluid and entrained cleaning balls out of the ball collection capsule in a second flow direction. The ball collection capsule is adapted to permit flow of only fluid, without entrained cleaning balls, through the ball collection capsule in both the first flow direction and the second flow direction. A plurality of valves is mounted to the piping manifold and operative to create alternately a first fluid flow path and a second fluid flow path through the piping manifold. The first fluid flow path includes a first leg from the second inlet to the first outlet through the ball collection capsule in the first flow direction and further includes a second leg from the first inlet to the second outlet. The second fluid flow path includes a third leg from the first inlet to the second outlet through the ball collection capsule in the second flow direction and additionally includes a fourth leg from the second inlet to the first outlet.

Pursuant to a feature of the present invention, the piping manifold includes two primary conduits and three secondary conduits. Each of the three secondary conduits extends between the two primary conduits. The ball collection capsule is disposed in a first one of the three secondary conduits. The first inlet and the first outlet are located at opposite ends of a first one of the two primary conduits, while the second inlet and the second outlet are located at opposite ends of a second of the two primary conduits.

The valves preferably include a first valve in the second primary conduit between the second inlet and the first secondary conduit, a second valve in the first primary conduit between the first secondary conduit and the first outlet, a third valve in a second one of the three secondary conduits, a fourth valve in a third one of the three secondary conduits, a fifth valve in the first primary conduit between the first inlet and the first secondary conduit, and a sixth valve in the second primary conduit between the first secondary conduit and the second outlet.

The two primary conduits preferably extend horizontally, the second primary conduit being disposed vertically above the first primary conduit. The three secondary conduits preferably extend vertically in parallel to each other, the first secondary conduit being disposed between the second and the third secondary conduits.

The ball circulation pump skid may further comprise a control unit mounted to the base frame. The control unit is a numerical control unit or more preferably a microprocessor operatively connected to the pump and the valves for coordinating or synchronizing the operation and actuation thereof.

The third valve may be located in a lower end portion of the second secondary conduit, while the fourth valve is located in a lower end portion of the third secondary conduit. The manifold may be further provided with a first filter screen disposed in an upper end portion of the second secondary conduit and a second filter screen disposed in an upper end portion of the third secondary conduit. The filter screens are fastened to the respective secondary conduits, internally thereof.

Pursuant to particular features of the present invention, the ball collection capsule is provided at a first end with a perforate wall or panel configured to permit fluid passage and to prevent ball passage. The ball collection capsule is provided at a second end with at least one opening large enough to permit passage of fluid together with entrained balls alternately into and out of the ball collection capsule (depending on the phase of the operating cycle). The first flow direction extends from the second end towards the first end of the ball collection capsule, while the second flow direction extends from the first end towards the second end thereof.

Pursuant to the above description, a piping manifold for a ball circulation pump skid comprises, in accordance with the present invention, a conduit network having a first inlet and a first outlet both connectable to a pump and additionally having a second inlet and a second outlet connectable to a target device. A ball collection capsule disposed within the conduit network is provided at a first end with a perforate wall or panel configured to permit fluid passage and to prevent ball passage. The ball collection capsule is provided at a second end with at least one opening large enough to permit passage of fluid and entrained balls into and out of the ball collection capsule. Valves are mounted to the conduit network and are operative to create alternately a first fluid flow path and a second fluid flow path through the conduit network. The first fluid flow path includes a first leg from the second inlet into the ball collection capsule through the at least one opening and from the ball collection capsule through the perforate wall or panel to the first outlet. The first fluid flow path also includes a second leg from the first inlet to the second outlet. The second fluid flow path includes a third leg from the first inlet through the perforate wall or panel of the ball collection capsule and from the ball collection capsule through the at least one opening to the second outlet. The second fluid flow path additionally includes a fourth leg from the second inlet to the first outlet.

The conduit network includes the configuration of two primary conduits and three secondary conduits discussed above and the same positioning for the inlets and outlets. The valves preferably have the distribution detailed above.

A hydraulic method for use with a ball circulation pump skid comprises, pursuant to the present invention, operating a pump to move fluid through a hydraulic circuit including an operative device and a manifold of the ball circulation pump skid. During the operating of the pump, valves in the manifold are selectively actuated. The actuation of the valves is timed and coordinated to (a) direct ball-containing fluid from the operative device in a first direction through a ball collection capsule in the manifold to thereby capture balls from the fluid, (b) guide ball-free fluid from the ball collection capsule to the pump and back to the manifold, (c) direct the ball-free fluid from the pump in a second direction through the ball collection capsule to entrain the balls captured therein, and (d) move ball-entraining fluid from the ball collection capsule in the manifold to the operative device.

The directing of the ball-containing fluid from the operative device in the first direction through the ball collection capsule includes feeding the ball-containing fluid through at least one opening at one end of the ball collection capsule.

The guiding of the ball-free fluid from the ball collection capsule to the pump includes flowing the ball-free fluid through a filter screen or panel at an end of the ball collection capsule opposite the at least one opening.

The directing of the ball-free fluid from the pump in the second direction through the ball collection capsule includes moving the ball-free fluid through the filter screen or panel from a side thereof opposite the at least one opening.

The moving of the ball-entraining fluid from the ball collection capsule includes guiding cleaning balls and fluid from the capsule through the at least one opening.

Accordingly, a preferred embodiment of the present invention utilizes six valves to effectively bypass the pump, eliminating the interaction between the pump and the cleaning balls. Not only does this result in a more cost effective and efficient pump that consumes less power, but also allows the skid itself to be reduced in size dramatically. The selective opening and closing of the valves in synchronization allows the cleaning balls entering the pump skid inlet to collect in the perforated screen capsule preferably located in a central conduit of the piping manifold upstream of the pump. Free of cleaning balls, the flow continues out of the manifold to pass through the pump and ultimately exit the skid to move to the injection point upstream of the condenser or heat exchanger or other operative device. During an injection phase of an operating cycle, the flow is diverted through a small screen upstream to pass through the pump and enter the central manifold conduit. The cleaning balls collected in the previous phase of an operating cycle are entrained with the flow, exiting the manifold and traveling out of the pump skid to the injection point upstream of the equipment serviced. Not only does this flow pattern eliminate the possibility of cleaning balls interacting with the pump but allows the cleaning balls to be injected as a lot rather than continuously as in current skid designs. This solution or modification has the added benefit of increasing the cleaning efficiency of the system.

BRIEF DESCRIPTION OF THE DRAWINGS

FIG. 5 is a front elevational view of a central vertical conduit in the pump skid of FIGS. 1-4.

FIG. 6 is a side elevational view of the central vertical conduit of FIG. 5.

FIG. 11 is a top plan view of a pipe included in the pump skid of FIGS. 1-4.

FIG. 12 is a side elevational view of the pipe of FIG. 11.

DETAILED DESCRIPTION

Figure 1:
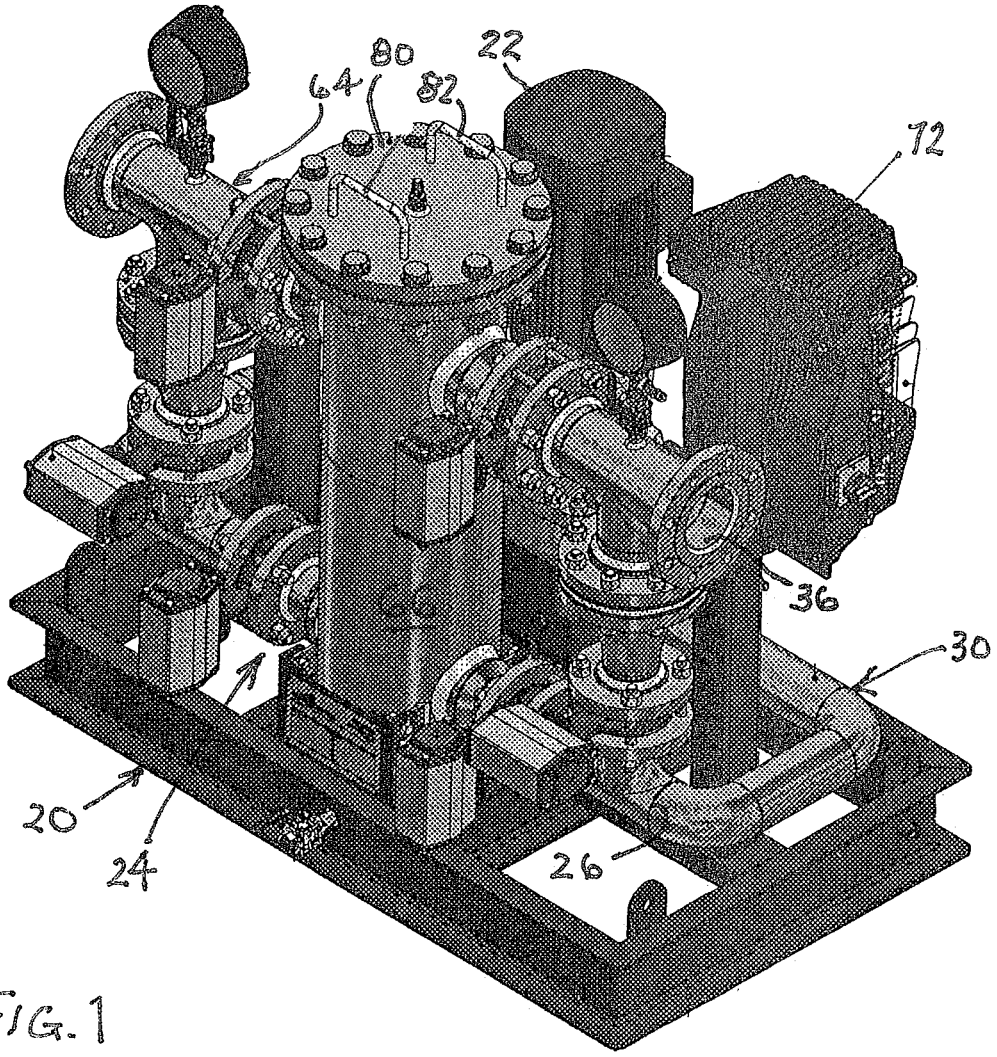
FIG. 1 is an isometric view of a ball circulation pump skid in accordance with the present invention.
Figure 2:
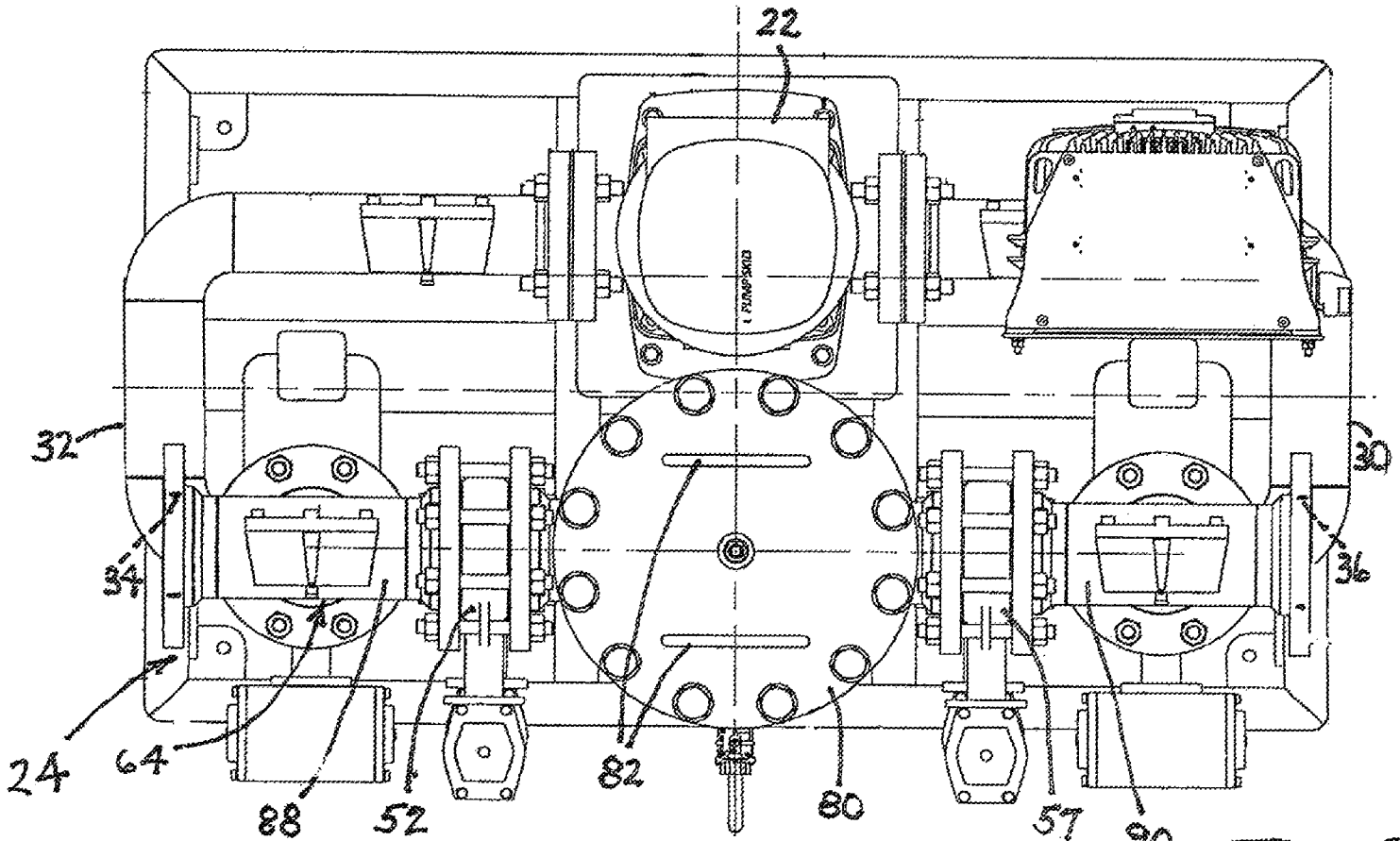
FIG. 2 is a top plan view of the pump skid of FIG. 1.
Figure 3:
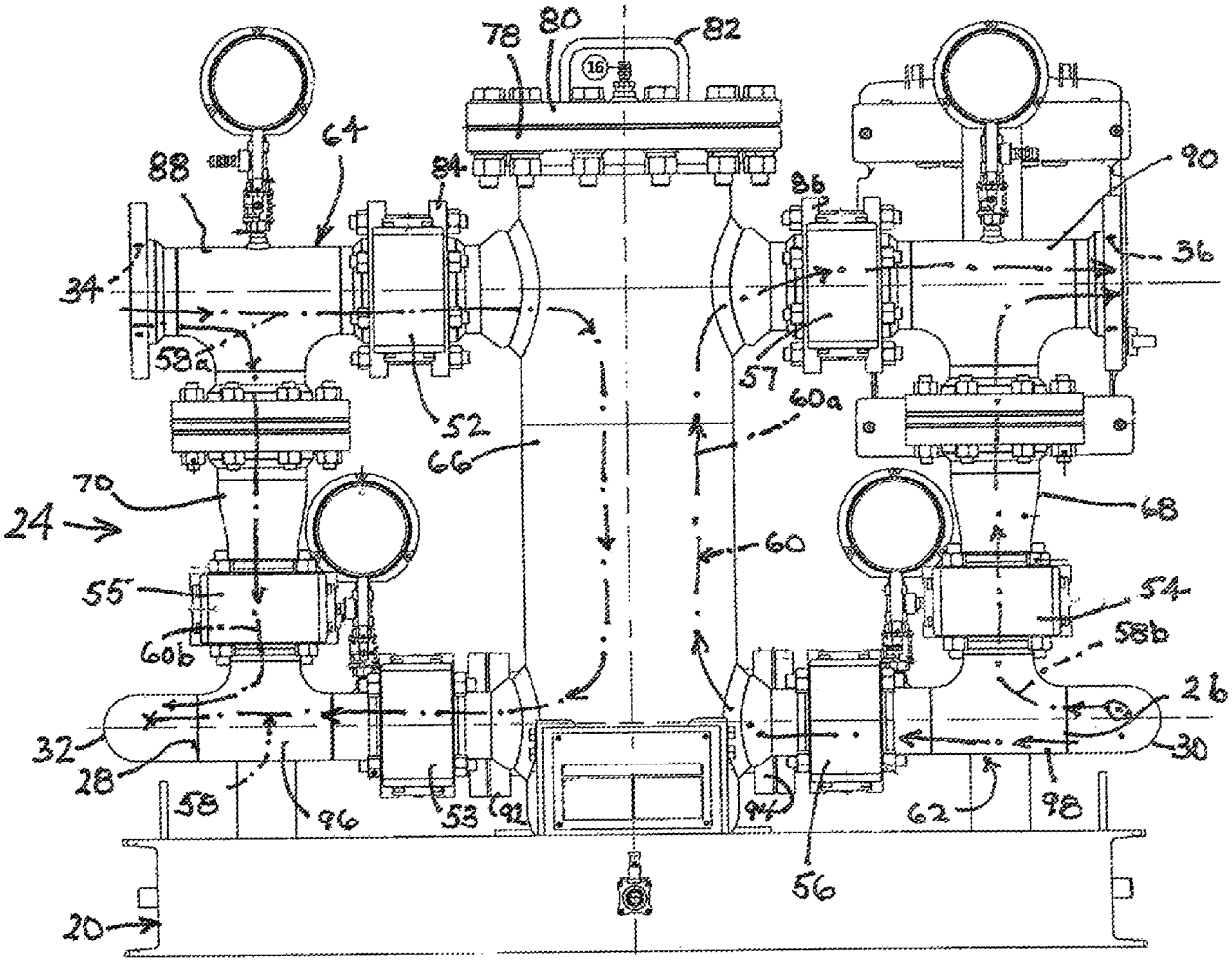
FIG. 3 is a front elevational view of the pump skid of FIGS. 1 and 2.
Figure 4:
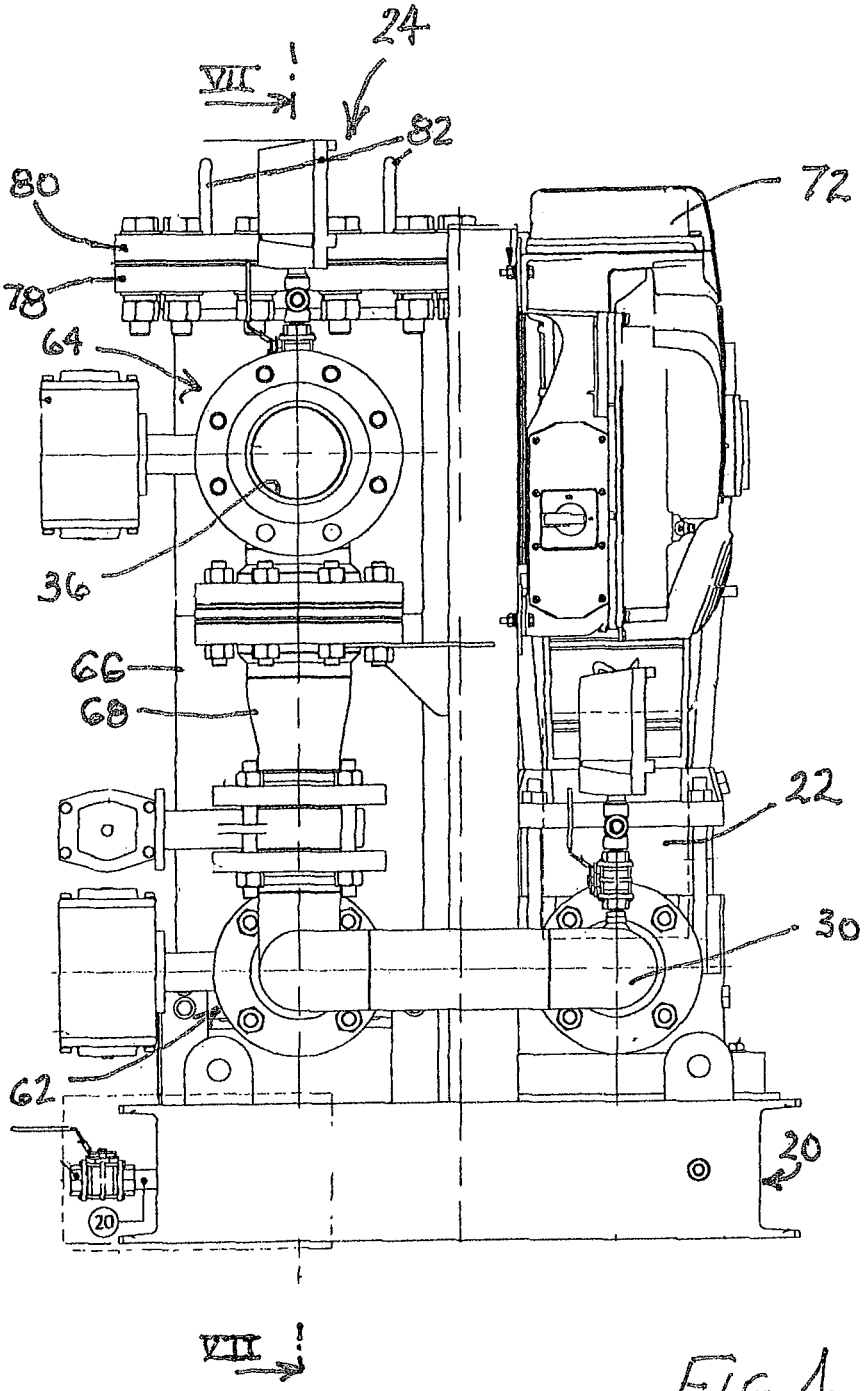
FIG. 4 is a side elevational view of the pump skid of FIGS. 1-3.
Figure 7:
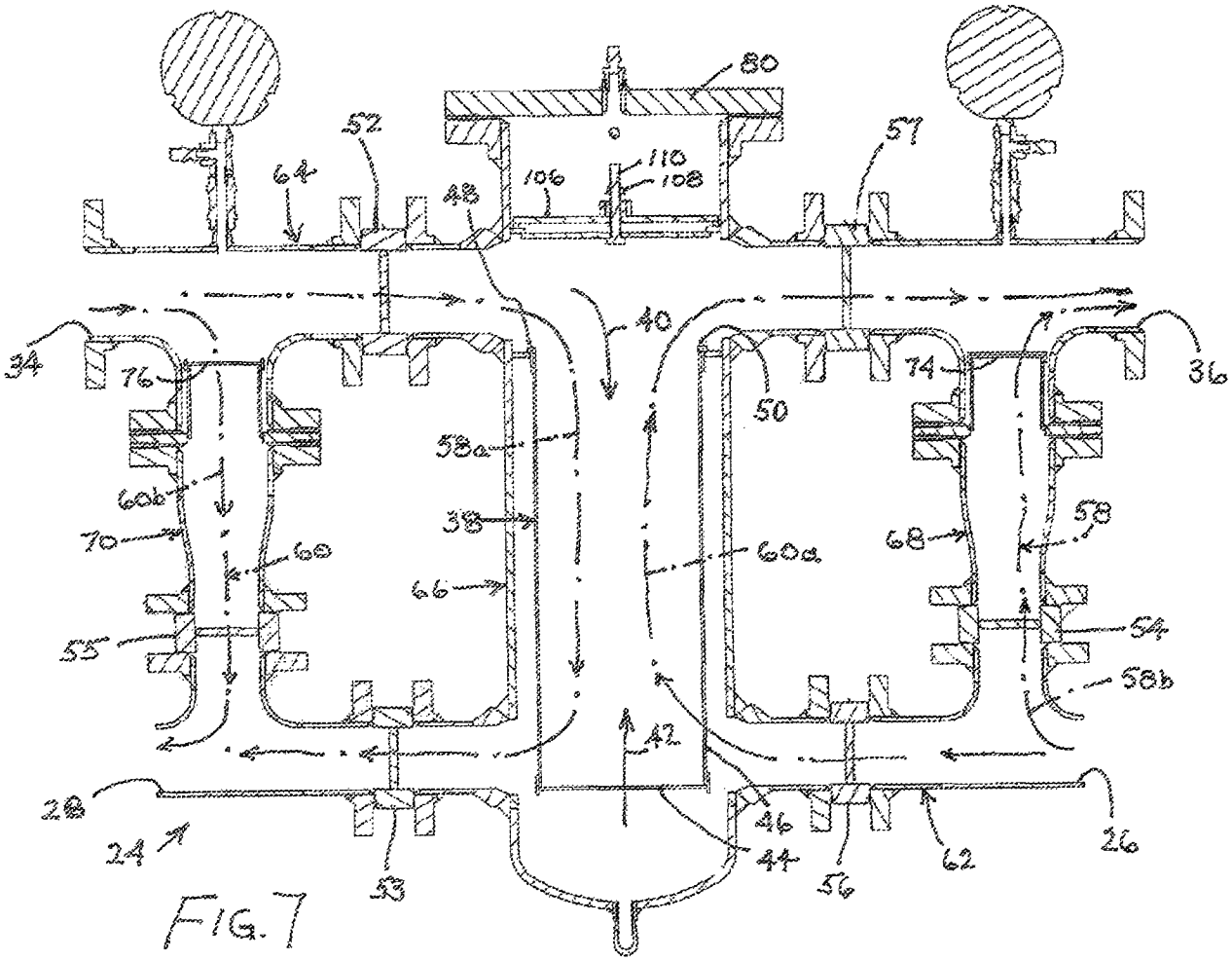
FIG. 7 is a cross-sectional view taken along line VII-VII in FIG. 4, on a larger scale.

A ball circulation pump skid comprises a base frame 20, a pump 22 mounted to the base frame, and a piping manifold 24 also mounted to the base frame. Piping manifold 24 has a first inlet 26 and a first outlet 28 (FIG. 7) connected to pump 22 via respective truncated U-shape pipes 30 and 32 (FIGS. 11 and 12). Manifold 24 is further provided with a second inlet 34 and a second outlet 36 (FIG. 7) connectable to an external device (not shown), such as a condenser or heat exchanger.

Manifold 24 houses a ball collection capsule 38 (FIGS. 7-10) configured to permit flow of fluid and entrained cleaning balls into the ball collection capsule in a first flow direction 40 (FIG. 7) and to permit flow of fluid and entrained cleaning balls out of the ball collection capsule in a second flow direction 42. Ball collection capsule 38 is adapted to permit flow of only fluid, without entrained cleaning balls, through the ball collection capsule in both the first flow direction 40 and the second flow direction 42.

Ball collection capsule 38 is provided at a lower end (not designated) with a perforate wall or panel 44 configured to permit fluid passage and to prevent ball passage. End wall or panel 44 and, optionally, a cylindrical sidewall 46 of capsule 38 are formed as screens or filter panels that block passage of cleaning balls but permit liquid flow through. Ball collection capsule 38 is provided at an upper end (not designated) with at least one opening 48 and preferably two opposed openings 48 and 50 large enough to permit passage of fluid together with entrained balls alternately into and out of the ball collection capsule (depending on the phase of the operating cycle, as described hereinafter). Flow direction 40 extends from opening 48 at the second end towards end wall or panel 44, while the second flow direction 42 extends from wall or panel 44 towards opening 50 at the top or upper end of ball collection capsule 38.

Six valves 52-57 are mounted to manifold 24 for controlling the flow of fluid therethrough. More particularly, valves 52-57 are jointly operative to create alternately a first fluid flow path 58 and a second fluid flow path 60 through the piping manifold. Flow path 58 includes a first leg **58*a* from inlet 34 to outlet 28 through ball collection capsule 38, overlapping the first flow direction 40, and further includes a second leg 58*b* from inlet 26 to outlet 36. Flow path 60** includes a leg 60*a* from inlet 26 to outlet 36 through ball collection capsule 38, coinciding in part with the second flow direction 42, and additionally includes a leg 60*b* from inlet 34 to outlet 28.

Piping manifold 24 includes two primary conduits 62 and 64 and three secondary conduits 66, 68, 70. Each of secondary conduit 66, 68, 70 extends between primary conduits 62 and 64. Ball collection capsule 38 is disposed in a first one 66 of the three secondary conduits 66, 68, 70. Inlet 26 and outlet 28 are located at opposite ends of one primary conduit 62, while inlet 34 and outlet 36 are located at opposite ends of the other primary conduit 64.

Valves 52-57 include a first valve 52 in primary conduit 64 between inlet 34 and secondary conduit 66, a second valve 53 in primary conduit 62 between secondary conduit 66 and outlet 28, a third valve 54 in a second secondary conduit 68, a fourth valve 55 in a third secondary conduit 70, a fifth valve 56 in primary conduit 62 between inlet 26 and secondary conduit 66, and a sixth valve 57 in primary conduit 64 between secondary conduit 66 and outlet 36.

The two primary conduits 62 and 64 extend horizontally, primary conduit 64 disposed vertically above primary conduit 62 and parallel thereto. Secondary conduits 66, 68, 70 preferably extend vertically in parallel to each other, secondary conduit 66 being disposed between conduits 68 and 70.

The ball circulation pump skid may further comprise a control unit 72 mounted to base frame 20. Control unit is a numerical-control unit or more preferably a microprocessor operatively connected to pump 22 and valves 52-57 for coordinating or synchronizing the operation and actuation thereof.

Third valve 54 is disposed in a lower end portion (not separately designated) of secondary conduit 68, while fourth valve 55 is positioned in a lower end portion (not separately designated) of secondary conduit 70. Manifold 24 further houses a filter screen 74 in an upper end portion (not separately designated) of secondary conduit 68 and a filter screen 76 in an upper end portion (not separately designated) of secondary conduit 70. Filter screens 74 and 76 are fastened to respective secondary conduits 68 and 70, internally thereof. Filter screens 74 and 76 together with perforate wall or panel 44 and optionally cylindrical sidewall 46 of capsule 38 serve to isolate the pump from the cleaning balls, preventing the balls from ever reaching or entering the pump.

Figure 8:
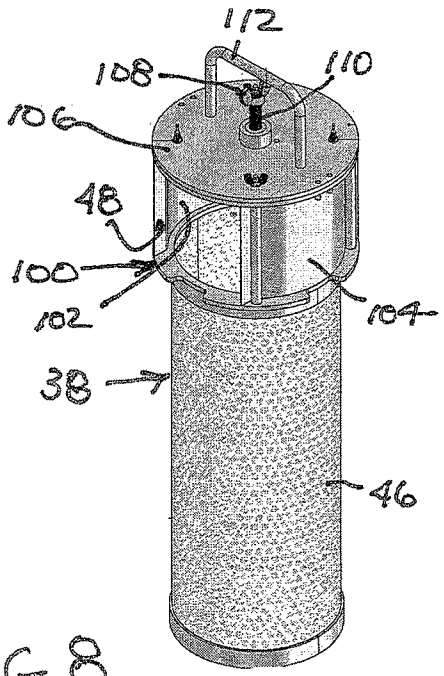
FIG. 8 is an isometric view of a ball collection capsule housed in the central vertical conduit of FIGS. 1-7.
Figure 9:
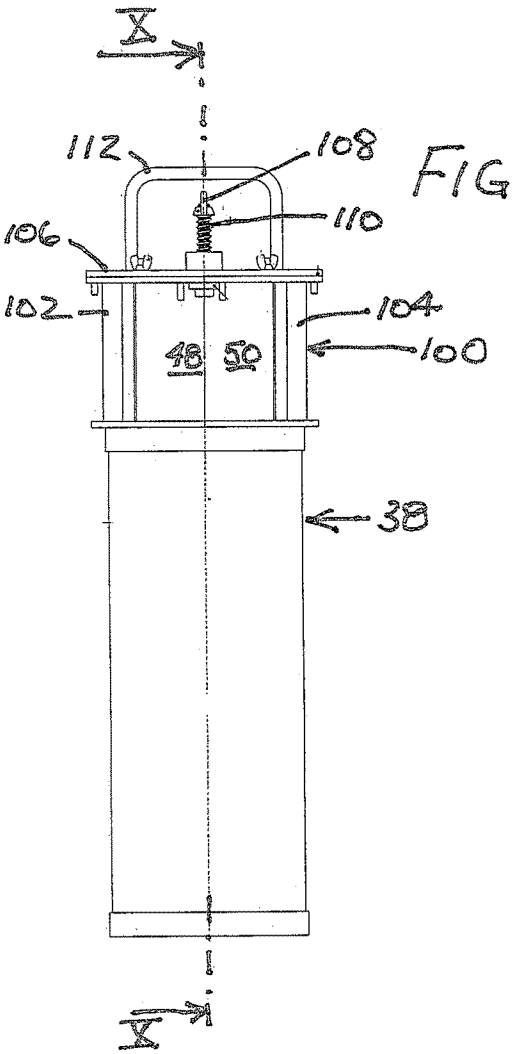
FIG. 9 is a side elevational view of the ball collection capsule of FIG. 8.
Figure 10:
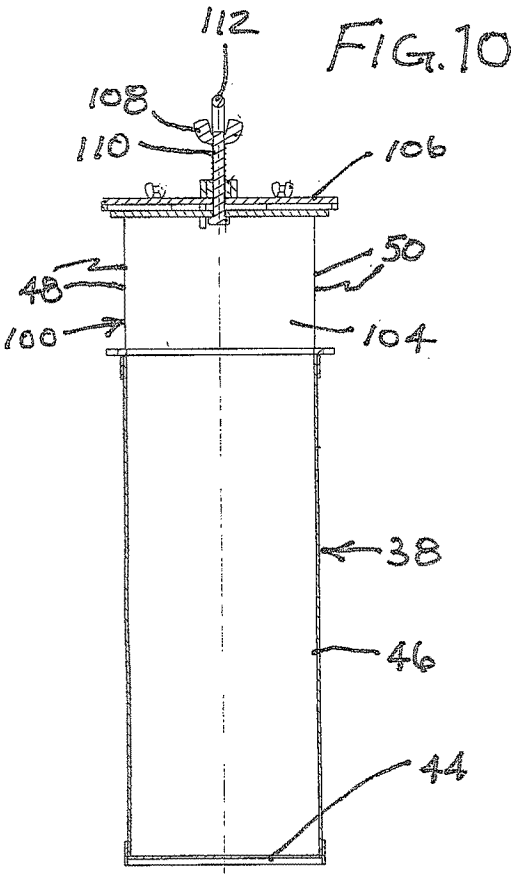
FIG. 10 is a cross-sectional view taken along line X-X in FIG. 9.
Figure 13:
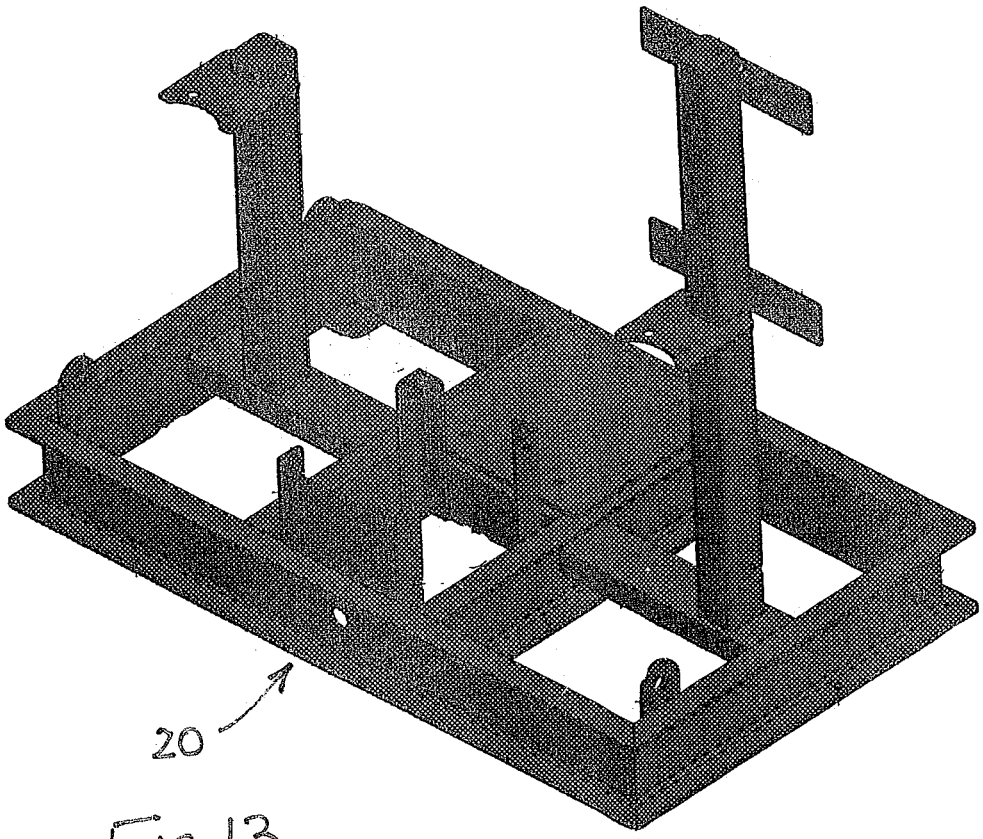
FIG. 13 is an isometric view of a base frame of the pump skid of FIGS. 1-4.

As depicted in FIGS. 8-10, ball collection capsule 38 includes a cap member 100 with a pair of opposed sidewalls 102 and 104 in the form of cylindrical sections that together define opening 48 on one side and opening 50 on another side. Cap member 100 is provided with a cover plate 106 removably attached to the upper end of cap member 100 via a wing nut 108 and bolt 110. A U-shaped rod 112 serves as a hand grip.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A hydraulic method for use with a ball circulation pump skid, comprising:

providing a hydraulic circuit having exactly one pump for moving fluid through the hydraulic circuit, said hydraulic circuit including an external device and a manifold of the ball circulation pump skid, a plurality of cleaning balls being disposed in said fluid;

operating said exactly one pump to move fluid through said hydraulic circuit including said external device and said manifold;

during the operating of said exactly one pump, selectively actuating valves in said manifold; and by virtue of the selective actuation of said valves:

(a) during a first of exactly two modes of fluid-flow of the hydraulic circuit, said first of said exactly two modes being implemented by a first state of actuation of said valves, directing fluid from said external device only along a first path, extending in part through said manifold and through a ball collection capsule in said manifold, to thereby capture, in said ball collection capsule, cleaning balls in the fluid flowing from said external device in said first state of actuation of said valves, and form ball-free fluid, (b) during said first of said exactly two modes of fluid-flow, guiding the ball-free fluid from said ball collection capsule along said first path directly to said pump only and from said pump directly only back to said manifold, (c) during a second of said exactly two modes of fluid-flow of the hydraulic circuit, said second of said exactly two modes being implemented by a second state of actuation of said valves different from said first state of actuation, directing all of the ball-free fluid from said pump along a second path directly to said manifold only and through said ball collection capsule therein to entrain the cleaning balls therein and to thereby form ball-entraining fluid, and (d) during the second of said exactly two modes of fluid-flow, moving the ball-entraining fluid from said ball collection capsule in said manifold along said second path directly only to said external device.

2. The method defined in claim 1 wherein the directing of said ball-containing fluid from said external device through said ball collection capsule includes feeding the fluid from said external device through at least one opening at one end of said ball collection capsule.

3. The method defined in claim 2 wherein the guiding of said ball-free fluid from said ball collection capsule to said pump includes flowing said ball-free fluid through a filter screen or panel at an end of said ball collection capsule opposite said at least one opening.

4. The method defined in claim 3 wherein the directing of the ball-free fluid from said pump through said ball collection capsule during said second of said exactly two modes of fluid-flow of the hydraulic circuit includes moving said ball-free fluid through said filter screen or panel from a side thereof opposite said at least one opening.

5. The method defined in claim 4 wherein the moving of the ball-entraining fluid from said ball collection capsule includes guiding cleaning balls and fluid from said ball collection capsule through another opening at said one end of said ball collection capsule.

6. A hydraulic method for use with a ball circulation pump skid, comprising:

providing a hydraulic circuit having exactly one pump for moving fluid through the hydraulic circuit, a plurality of cleaning balls being disposed in said fluid, said hydraulic circuit including an external device and a manifold of the ball circulation pump skid, said manifold including a ball collection capsule and a plurality of valves;

operating said exactly one pump and said valves to move said fluid in said hydraulic circuit, including said external device and said manifold, alternately along a first path and a second path, said manifold being configured so that none of the balls ever enter said exactly one pump, wherein said first path enables (a) ball-containing fluid flow from said external device directly to said manifold only and to said ball collection capsule therein and (b) ball-free fluid flow from said ball collection capsule and from said manifold directly to said exactly one pump only and from said exactly one pump directly back to said manifold only, wherein said second path provides for (c) said ball-free fluid flow from said exactly one pump directly to said manifold only and to said ball collection capsule therein and (d) ball-entraining flow from said ball collection capsule and said manifold directly only to said external device.

7. The method defined in claim 6, further comprising preventing the cleaning balls from traveling to or entering said pump, while enabling the flow of ball-free fluid from said manifold to said pump both along both said first path and said second path.

8. The method defined in claim 6 wherein said first path extends through or traverses a filter screen or panel of said ball collection capsule.

9. The method defined in claim 6 wherein said second path extends through or traverses a filter screen or panel of said ball collection capsule, further comprising moving ball-free fluid from said pump into said ball collection capsule through a filter screen or panel of said ball collection capsule.

10. A hydraulic method for use with a ball circulation pump skid, comprising:

providing a hydraulic circuit having exactly one pump for moving fluid through the hydraulic circuit, said hydraulic circuit including an external device and a manifold of the ball circulation pump skid, said manifold including a plurality of valves, a plurality of cleaning balls being disposed in said fluid; and operating said exactly one pump and said valves to move fluid in said hydraulic circuit through said hydraulic circuit, including said external device and said manifold, alternately along a first path and a second path to:

channel fluid flow in said hydraulic circuit along said first path from said external device directly to said manifold directly and through a ball collection capsule in said manifold to capture, in said ball collection capsule, the cleaning balls from the fluid flow therethrough, guide ball-free fluid along said first path from said ball collection capsule and from said manifold directly to said exactly one pump only and from said exactly one pump directly only back to said manifold, flow the ball-free fluid from said exactly one pump along said second path directly to said manifold only and to said ball collection capsule therein and through same to entrain the cleaning balls captured therein, and move ball-entraining fluid along said second path from said ball collection capsule and directly from said manifold only to said external device.

11. The method defined in claim 10, further comprising preventing balls from traveling from said manifold to said pump, while enabling the flow of ball-free fluid from said manifold to said pump both along said first path and said second path.

* * * * *